United States Patent [19]

Malish et al.

[11] 4,114,225

[45] Sep. 19, 1978

[54] BRUSH-LIKE MOUNTING DEVICE

[75] Inventors: Terrance J. Malish, Willoughby Hills; Martin J. Hulin, Euclid, both of Ohio

[73] Assignee: Malish Brush & Specialty Company, Willoughby, Ohio

[21] Appl. No.: 814,491

[22] Filed: Jul. 11, 1977

[51] Int. Cl.[2] ..... A46B 9/02; A46B 13/02; A47L 11/14

[52] U.S. Cl. ..... 15/230.17; 15/180; 15/DIG. 5

[58] Field of Search ..... 15/28, 29, 49 R, 50 R, 15/180, 230.17, 230.19, DIG. 5; 24/204; 51/358, 400

[56] References Cited

U.S. PATENT DOCUMENTS

| | | | |
|---|---|---|---|
| 2,174,214 | 9/1939 | Quinn | 15/180 X |
| 3,005,219 | 10/1961 | Miller | 24/204 UX |
| 3,011,190 | 12/1961 | Wilke | 15/49 R |
| 3,024,883 | 3/1962 | Eriksson | 15/28 X |
| 3,026,552 | 3/1962 | Price | 15/230 X |
| 3,121,895 | 2/1964 | Burgoon | 15/50 R |
| 3,312,994 | 4/1967 | Fassio | 15/180 |
| 3,386,122 | 6/1968 | Mathison | 15/230.17 |
| 3,459,109 | 8/1969 | Ingleright | 15/180 X |
| 4,014,064 | 3/1977 | Okazaki | 15/DIG. 5 |

FOREIGN PATENT DOCUMENTS

| | | | |
|---|---|---|---|
| 806,890 | 2/1969 | Canada | 51/358 |
| 1,063,397 | 12/1953 | France | 15/28 |
| 1,346,635 | 11/1963 | France | 15/180 |
| 1,149,331 | 7/1957 | France | 15/28 |

*Primary Examiner*—Daniel Blum
*Attorney, Agent, or Firm*—Teare, Teare & Sammon

[57] ABSTRACT

The present invention provides a brush-like mounting device of the type for detachably mounting a cleaning, stripping, scrubbing, polishing or the like type member, such as a pad, for commercial, industrial and/or residential applications. The device includes a generally rigid body member having at least one generally planar side surface. First retention means, including resilient filament means, extends from this surface for coacting gripping engagement with a pad; and second retention means including resilient filament means extends from said surface and angularly in respect to said first retention means for coacting gripping engagement with the confronting surface of said pad and with said first and second filament means coacting for detachably mounting said pad on said mounting device.

7 Claims, 8 Drawing Figures

BRUSH-LIKE MOUNTING DEVICE

BACKGROUND OF THE INVENTION

The present invention relates generally to mounting devices for cleaning, stripping, scrubbing, polishing, or the like applications, and more particularly relates to an improved construction for a brush-like mounting device adapted for use in detachably mounting a cleaning, stripping, scrubbing, polishing or the like pad element for use with single and/or multiple cleaning machines of the manual or automatic types. More particularly, the present invention has particular application in providing a brush-like mounting device for mounting replaceable cleaning, stripping, scrubbing or polishing pad elements for use with single and/or multiple automatic for commercial and/or industrial application.

Heretofore, various arrangements have been provided for detachably mounting a cleaning, stripping, scrubbing, polishing or the like type pad on a mounting member which, in turn, was adapted to be mounted on a cleaning or scrubbing machine. Such prior arrangements have generally included the use of various nut and bolt and/or bracket plate fastening systems. More recently, the mounting member has been provided in a form of a circular block or disc having a plurality of polymeric (plastic) filaments extending outwardly from the bottom surface of the disc for holding the pad by a mechanical gripping action. The pad has generally been made from a mass of synthetic (plastic) fibers in the form of an interwoven porous pad. In such cases, the locking action was provided by the mechanical penetration of the polymeric filament ends within the interstices provided by the fibers of the pad. It has been found, however, that such prior arrangements have not been completely satisfactory for a number of reasons.

In the case of the single brush (manual) machine, one such problem as related to the inability to properly "heel" the machines during normal usage. That is to say, the ability to tilt the scrubber head backwardly in order to raise the mounting device which carries the pad when attempting to negotiate an abutment surface, such as a door threshold or the like. Moreover, with the prior devices, (brush type) when the machine was heeled back, the pad had a tendency to become displaced requiring repositioning of the same after the machine was moved to a location past the abutment surface for continuance of the cleaning operation.

Another problem resides in the tendency of the pad element to walk-off the mounting disc during normal usage, particularly at relatively high operating speeds. Hence, in such cases the pad tends to rotate with an eccentric action which reduces the efficiency and, hence, the performance characteristics of the device otherwise obtainable where the pad is maintained in a concentric relationship with the mounting disc.

A further problem relates to the tendency of the pad element to deform, such as by shrinkage due to the inability to maintain the pad at right angles to the surface to be cleaned with a constant, generally uniform pressure during normal usage. This is a particular problem with scrubbers (automatic) utilizing multiple pad elements. Here, for example, when a pair of oppositely disposed pad elements shrink, a space or gap is produced which results in the surface to be cleaned being streaked or left with strips of uncleaned areas. In such cases, the useful life of the pad element is greatly reduced requiring continual and costly replacements of the pad elements.

Typical of prior type devices are illustrated in U.S. Pat. Nos. 3,014,318, 3,026,552 and 1,675,078.

SUMMARY OF THE INVENTION

The present invention relates to an improved construction for a brush-like mounting device for detachably mounting cleaning elements of the type for use in cleaning, stripping, scrubbing, polishing and the like operations. The device includes a disc-like body member adapted to be detachably connected to a cleaning machine, such as a scrubber or the like. The disc-like member includes a plurality of resilient filament elements extending outwardly from one side thereof for coacting locking engagement with a pad element. The disc-like member includes a retention means comprising a support member in the form of an annular collar extending outwardly in the same general direction as said resilient filament elements. The support member includes other resilient filament elements extending transversely of said first mentioned filament elements for coacting locking engagement with said pad element with all of the filament elements conjunctively coacting to prevent movement of said pad element relative to said disc-like member. In another form, the retention means includes at least one inner row of resilient filament elements disposed at a predetermined angle with respect to round first mentioned filament elementes to provide such holding function.

By the foregoing arrangement an accompanying description and drawings, it will be seen that the present invention provides a new and novel instruction for a brush-like mounting device which is of a rugged, yet simple construction for detachably mounting a cleaning pad for cleaning, stripping, scrubbing, polishing and the like operations. The present invention has been found to obviate the difficulties with prior arrangements including the ability to "heel" the scrubber, increase the performance characteristics by reducing streaking due to "shrinkage", and by optimizing concentric rotation of the pad element, particularly during high speed applications. The device of the invention provides an arrangement which is quick and easy to install utilizing a minimum time and effort even when employed by relatively unskilled operators. For example, with single scrubber machines, one can quickly and easily install and/or interchange the scrubbing pads with the butting and/or polishing pads by merely "heeling" the machine to some extent beyond the vertical (90°). Hence, the invention provides a secure locking arrangement which prevents the pad from falling off during installation or upon normal usage, thereby facilitating installation and obviating the need for ancillary fastening systems and/or tools otherwise required by conventional type nut and bolt and/or bracket systems. Further, with the present invention the pad elements can be readily replaced with a minimum of time and effort. Here again, this can be accomplished simply by "heeling" the machine back to provide access for replacing the pad element.

DESCRIPTION OF THE PREFERRED EMBODIMENTS

Figure 1:
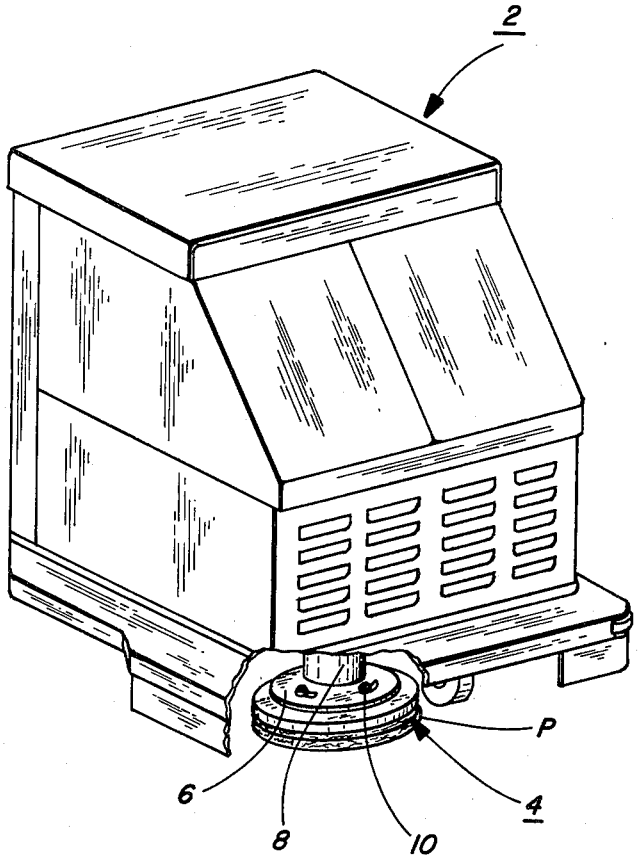
FIG. 1 is a fragmentary, generally perspective view of one form of the brush-like mounting device of the invention illustrated for use with a commercial, multi-brush scrubber apparatus.

Referring again to the drawings, and particularly referring to FIG. 1 thereof, there is generally illustrated a cleaning machine, designated generally at 2, such as an automatic scrubber. As known in the art, such scrubber apparatus includes a plurality of spindles for detachably mounting a corresponding number of brushes. In the present invention, there is provided a new and novel construction for a mounting device, designated generally at 4, which is detachably connected via a conventional type mounting plate 6 to the drive spindle 8 of the apparatus 2. The plate 6 is provided with conventional type key-way slot arrangement 10 for detachably connecting the device 4 to the spindle 8. As forementioned, this illustrates generally one form of the invention which is particularly adapted for use with a multi-brush scrubber apparatus and/or with a single brush-type apparatus. Preferable, the mounting device of the invention has particular application in respect to multi-type brush scrubber machines in relation to the ease of interchangeability, flexibility in use and efficiency in use, as aforesaid.

As best illustrated in FIGS. 2, 3, 4 and 5, the mounting device 4 of the present invention comprises a body member 12 of generally circular configuration (FIG. 3) defined by planar surfaces 14 and 16. It is to be understood, however, that the base member 12 may be of any other non-circular configuration, as desired. For example, the configuration may include polygonal configurations, such as hexagonal, octagonal, and other shapes having an included angle. Also, it should be clearly understood that the base member may comprise other symmetrical configurations, such as square, rectangular, as well as other non-circular configurations which are not readily definable by mathematical calculation.

Figure 2:
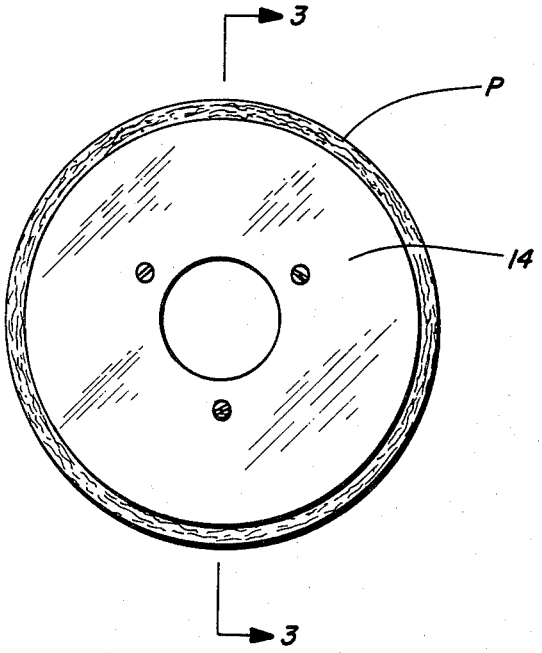
FIG. 2 is a top plan view of the mounting device carrying a pad in the invention.
Figure 3:
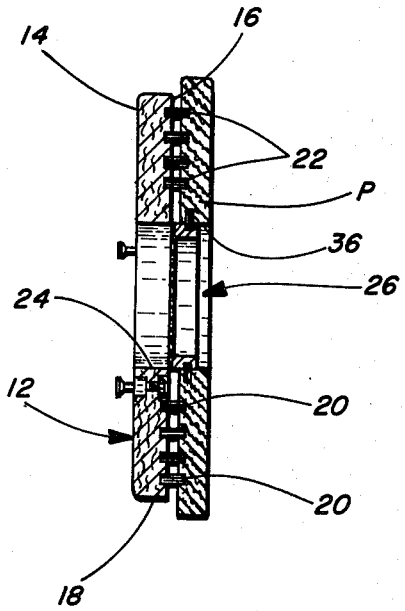
FIG. 3 is a vertical section view taken along the line 3—3 of FIG. 2.
Figure 4:
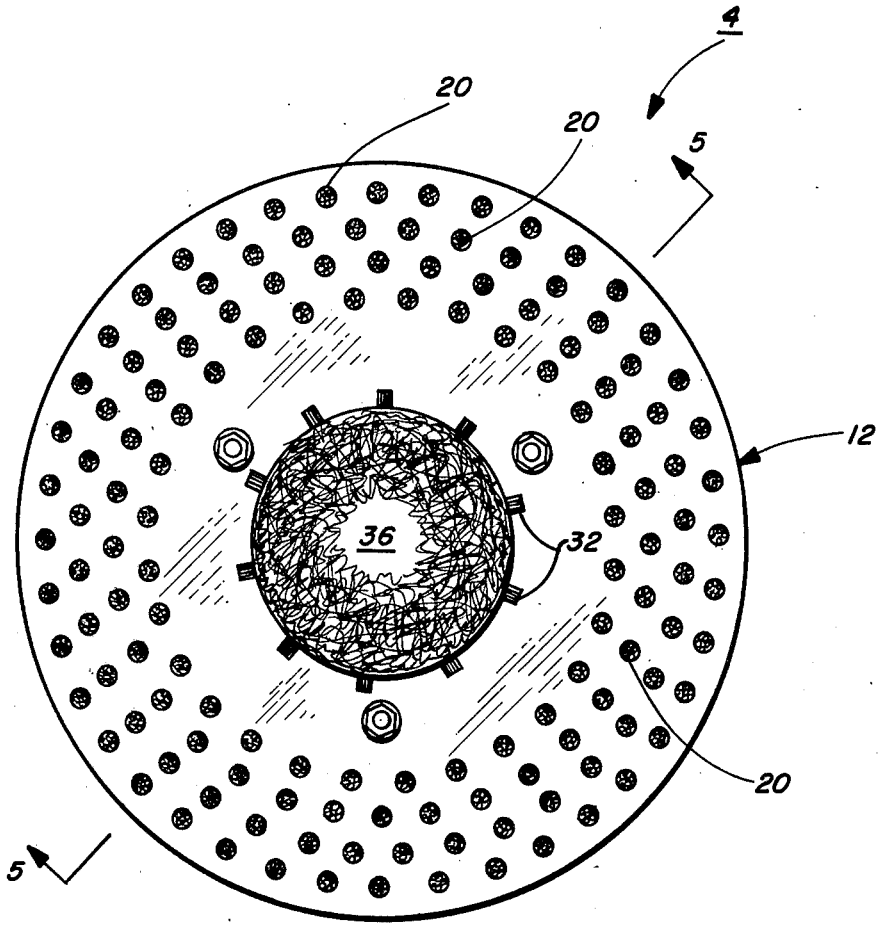
FIG. 4 is an enlarged bottom plan view of the mounting device of the invention.

As best illustrated in FIGS. 2, 3 and 4, the mounting device 4 is preferably of a generally circular configuration defined by an endless, outer peripheral edge 18 (FIG. 3) defining the configuration thereof. In the embodiment shown, the body member 12 includes a plurality of symmetrically disposed rings of filament bundles designated generally at 20. In the invention, the filament bundles 20 are arranged in concentric arrangement so as to define a plurality of circles, as at 22, in relation to a bore 24, provided in the center thereof for detachable connection (FIG. 1) with the machine spindle 8. Accordingly, any number of circles of filaments may be provided, dependent upon shape of the mounting device for a particular application. For example, in the embodiment shown, four concentric circles of filaments are illustrated for use with a base member 12 having a diameter of approximately 10 inches. In such cases, the individual bundles of filaments may be spaced approximately ½ inch apart in a radial direction and between about ⅝ inch to ⅞ inch apart in arcuate (i.e., circular) direction. In such case, the measurements are taken in respect to the geometric centers of the respective bundles. Further, the outermost concentric circle of bundles is preferably spaced approximately between ¼ inch and ⅜ inch from the outer peripheral edge 18 of the base 12.

In the invention, the individual bundles 20 may be disposed in any pattern so as to provide an effective mechanical gripping coacting engagement with a resilient pad element P such as a cleaning, stripping, scrubbing, polishing or similar type pad. Accordingly, the filament bundles 20 may be symmetrically arranged and/or randomly arranged in any pattern, as desired. For example, the filament bundles may have the aforesaid type of special relationship with the number of filament bundles decreasing in number in a direction from the outer edge 14 toward the center of the bore 24. For example, with a 10 inch diameter base member 12, the inside circle may have 28 bundles with a 3/16 inch diameter, the second circle may have 36 bundles with a 3/16 inch diameter, the third circle may have 40 bundles with a 3/16 inch diameter, the second circle may have 36 bundles with a 3/16 inch diameter, the third circle may have 40 bundles with a 3/16 inch diameter and the outer circle 52 bundles with a 3/16 inch diameter. In another arrangement, the filament bundles may be set so that each pair of outer bundles is disposed opposite a corresponding inner bundle so as to provide a generally triangular pattern with the rows, in effect, being disposed in a staggered or off-set relationship.

In this form of the invention, the individual filament bundles 20 may be mounted in the base member 12 by any conventional means, such as by staple-set, epoxy-set, crimped wire, wire-drawn, or the like, as known in the art. The staple-set is preferred. This utilizes a bore of approximately 3/16 inch filled with a 3/16 inch diameter bundle having a step, clipper trim. This trim shape has 3 to 6 filaments per hole producing 6 to 12 ends with approximately one-half the ends cut at ½ inch and with the other one-half cut at random lengths from 174 inch to 7/16 inch. In this embodiment, the filaments preferably project approximately ½ inch outwardly from the confronting surface 16 of the base 12.

The filaments are preferably made from a resilient, high strength material having good abrasive and wear characteristics, such as plastic or impregnated plastic material. A preferred material is a polypropylene material made commercially available under the trade mark name PROSTAN from the E. B. & A. C. Whiting Company. Also, the filaments may be made of other materials, such as metal, natural fibers.

Figure 5:
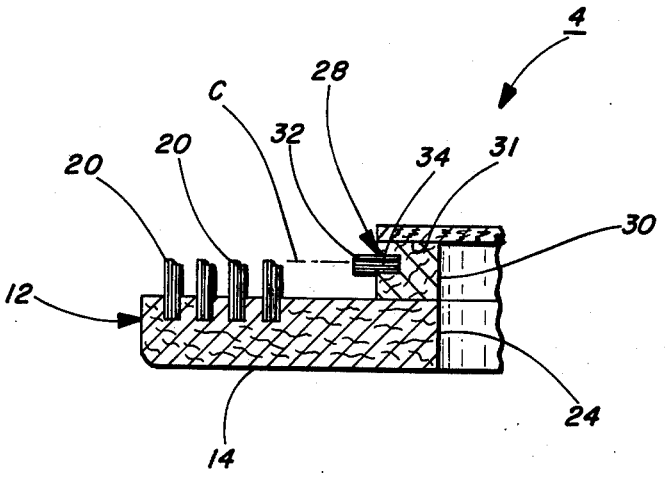
FIG. 5 is a fragmentary section view taken along the line 5—5 of FIG. 4.

In the embodiment illustrated, an inner retention means, designated generally at 26, is provided to prevent lateral shifting movement of the pad P. As shown, retention means 26 includes an annular ring-like collar member 28 defined by a bore 30 (FIG. 5) corresponding generally in diameter to the bore 24 in the base 12. This collar 28 may be provided with one or more rings of filament bundles 32 which may be similarly attached, such as by staple-set or the like, within bores 34 provided in the collar 28. In this form, the bores may be approximately 3/16 inch diameter on 1 inch centers. In this case, the collar 28 preferably has a height of approximately ¾ inch with each filament bundle 32 being spaced approximately ¼ inch from the top or outer surface 31 of the collar. By this arrangement, the geometric center-line C of the respective filament bundle 32 is preferably disposed in the same general plane, as defined by the terminal ends of the filament bundles 20 in the base member 12, as best seen in FIG. 5. This arrangement provides an effective optimum gripping engagement with the interior confronting surface of the pad P, as at 36 (FIG. 3) to prevent lateral shifting and rotational movement of the pad P relative to the base member 12. It will be appreciated, however, that any number of filament bundles and/or number of circles of filament bundles may be provided throughout the axial extent (length) of the collar 28 to insure the desired positive gripping action. In such case, for example, it is believed that a three-point engagement utilizing 3 filament bundles equally space would provide satisfactory results while only 2 filament bundles would be unsatisfactory. Similarly, there would be provided one or more continuous rows of filaments rather than a plurality of spaced bundles and/or incremental circles of bundles achieved, such as by a metal strip (not shown) disposed in a corresponding recess (not shown) provided in the collar.

In this form, for a ten inch diameter base, the filament bundles 20 preferably have a height between approximately ¾ inch and ½ inch with the other filament bundles 32 having a length of approximately ¼ inch. With this right angular, perpendicular relationship between the filament bundles 22 and 32, the filament bundles 32 preferably have a flat, trim shape, whereas, the filament bundles 22 have a clipped, step trim shape with the step portion thereof oriented inwardly. It is to be understood, however, that the step trim could be oriented outwardly, as desired.

In the invention, a protective cover 36 is secured, such as by an adhesive or the like, to the upper exposed surface 34 of the collar 28 to reduce and/or prevent accidental damage to the surface to be cleaned. This cover 36 may be made from any suitable material and is preferably an interwoven polymeric material commercially available under the trade name SCOTCH-BRITE from the 3M Company.

Figure 6:
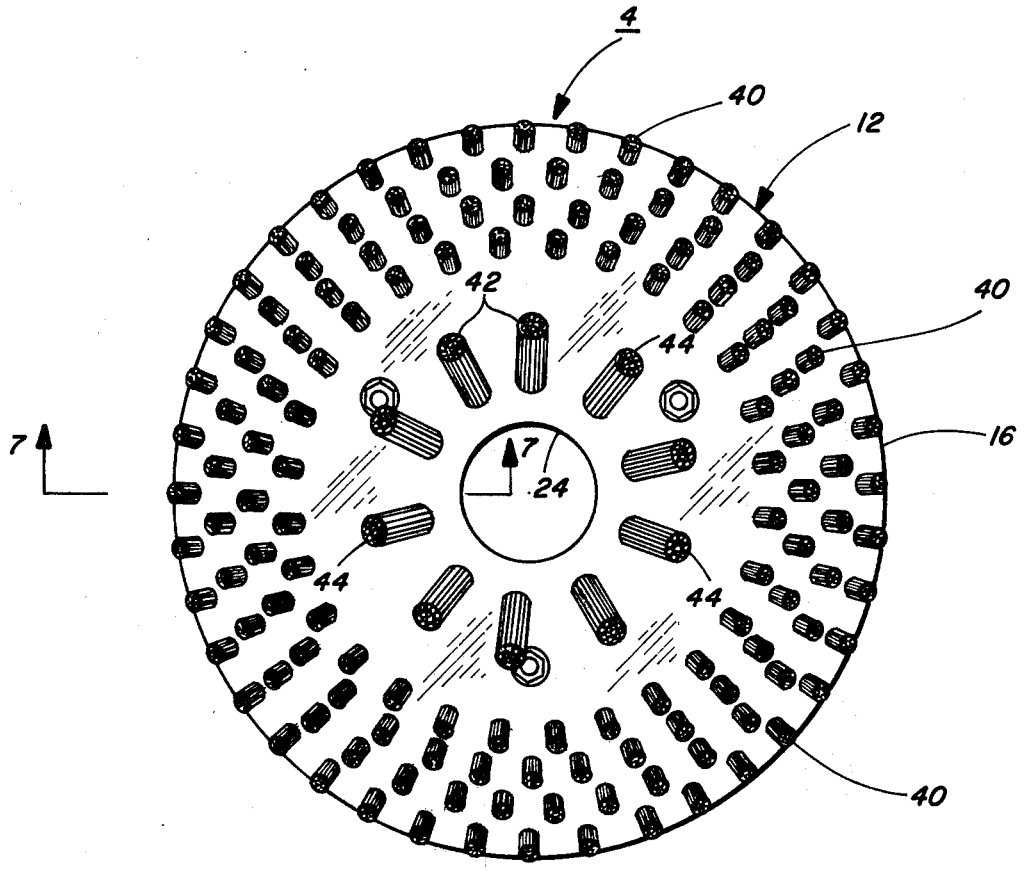
FIG. 6 is a bottom plan view of a modified form of the mounting device.
Figure 7:
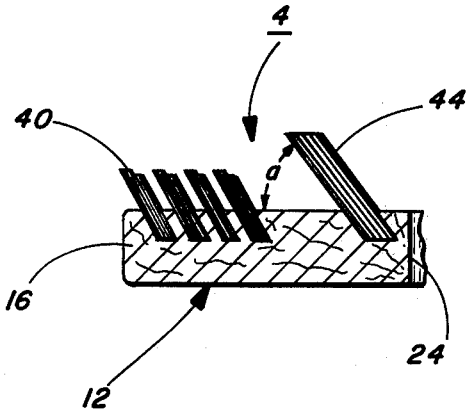
FIG. 7 is a fragmentary view taken along the line 7—7 of FIG. 6.

In FIGS. 6 and 7, there is illustrated another embodiment which is of generally identical construction, except for the annular orientation of the filament bundles and a modification in respect to the structure of the inner retention means. In this form, the filament bundles 40 in the base 12 are preferably angularly disposed so as to flare outwardly in a direction away from the bore 24 (FIG. 6) toward the outer peripheral edge 16, of the base. In such case, the angular orientation may be from 0° (i.e. 90°) to approximately 50° so as to define an acute angle with respect to the base 12. In a preferred range, the angular orientation is from 0° (i.e. 90°) to 35° and with the most preferred orientation being from 0° to 20°. This angular orientation in respect to the filament bundles is for base members having a diameter in the range from 7 inches to 23 inches. It has been found that with small diameter size base members, such as 7 inches to 13 inches, that the optimum angular orientation of the filament bundles is approximately 10° to 13°.

In the invention, the bundles may be disposed at the same degree of inclination, or certain circles of filament bundles may be disposed at progressively increased angles, as desired. For example, with four concentric circles of filament bundles, the innermost circle may be disposed at 5°, the second circle at 10°, the third circle at 15°, and the fourth or outer circle at 20°. In each case, it is preferred that each circle have an increased angular orientation of from 2° to 5° in relation to the proceeding circle so as to progressively increases in a direction toward the outer edge of the base. By this arrangement, it has been found that the angular disposition of the filament bundles effectively acts to provide a positive gripping engagement with the pad P and prevents shrinkage thereof, as aforesaid.

In this embodiment, there is illustrated a modification (FIG. 6) of the inner retention means, designated generally at 42. In this case, the retention means comprises an inner circle of filament bundles 44 which are disposed at an acute angle relative to the base 12. In this case, the filament bundles may be disposed at an angle (a) from 15° to approximately 60° with the preferred inclination being 45°. In such case, the filament bundles 44 extend between approximately ⅛ inch and ¼ inch above the general plane of the terminal ends of the filament bundles 40 to provide an interlocking gripping engagement with the confronting interior surface 36 (FIG. 3) of the pad P. In this form, the filament bundles have a generally flat trim configuration. Here again, the filament bundles may be on one inch spaced centers for a 10 inch diameter base member 12. Again, it is to be understood that any number of filament bundles may be employed, such as from three or more. Further, a continuous circle of filaments, such as provided by a metal strip insert or the like, may be utilized.

Figure 8:
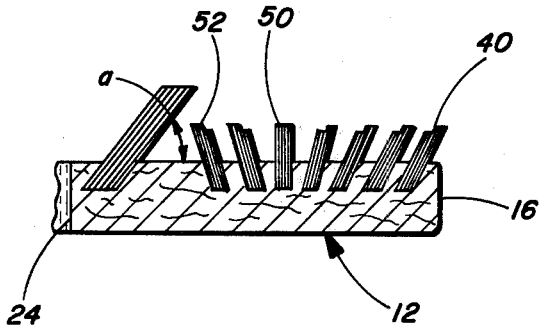
FIG. 8 is a fragmentary section view illustrating another modified form.

In FIG. 8 there is illustrated a further modification of the invention which is generally the same as that of FIG. 7, except that additional filament bundles 52 with the step trim are disposed inwardly of the outer filament bundles 40. In this case, the inner circles of filament bundles 52 are oriented at an acute angle different from that of the outer bundles 40. Preferably, the bundles 52 are disposed at an acute angle from 0° (i.e. 90°) to 30° with most preferred being from 0° (i.e. 90°) to 30°. Here, the first or central circle 50 is disposed at the 0° or 90° angle between the filament bundles 52 and 40.

In the invention, it has been found that the most preferred form of the mounting device 4 comprises the filament bundles 40 which are disposed at an acute angle in respect to the base when utilized in conjunction with the retention means 26 (FIG. 3) which embodies the collar 28 mounting filament bundles 20. Most preferably, the filament bundles 40 are disposed at an acute angle which progressively increases in a direction away from the geometric center of the base 12 toward the outer periphery thereof.

From the foregoing description, the accompanying drawings, and the following claims, it will be seen that the present invention provides a new and novel construction for a brush-like mounting device which may be quickly and easily applied for use in detachably mounting a cleaning, stripping, scrubbing, polishing or the like type pad element for use with single and/or multiple cleaning machines or the manual or automatic types. Specifically, the invention provides a new and novel structural arrangement which utilizes a first resilient, high strength filament retention means disposed in predetermined angular relationship with a second resilient, high strength filament retention which frictionally and mechanically coact for gripping engagement with the fibers and/or strands of a pad element to prevent lateral, rotational, and/or shrinking movement of the pad during normal usage thereof.

We claim:

1. A mounting device detachably mounting a fiber pad-like element having a central bore for assembly with a machine, such as for use in cleaning, stripping, scrubbing, polishing or the like, and of the type for rotating the mounting device about a vertical axis and in a generally horizontal plane substantially parallel to the work surface, said mounting device comprising, a generally circular body member of substantially flat construction defining an outer endless peripheral edge, said body member having a centrally disposed bore adapted to receive a drive spindle for detachable connection to said machine, first retention means including a multiplicity of resilient filament elements extending outwardly from one face of said body member adapted for supporting and mechanically gripping the fibrous material of said pad-like element, said filament elements being made of a high-strength polymeric material and disposed in a generally concentric circle with respect to the bore in said body member, second retention means including an annular collar member attached to said body member on the side remote from said machine, said collar member disposed in generally concentric relation around the bore in said body member, and a multiplicity of resilient filament elements made of polymeric material extending around the periphery and outwardly from said collar member, said last mentioned filament elements extending generally at right angles to said collar member and being spaced axially outwardly from said body member, the filament elements of said second retention means being disposed so as to be generally in the plane defined by the terminal ends of the filament elements of said first retention means, and the filaments in said body and collar members being angularly disposed with respect to one another so as to frictionally and mechanically grip said pad-like element on angularly disposed surfaces to prevent rotational and/or lateral shifting movement of the same relative to said body member during operation of said machine.

2. A mounting device in accordance with claim 1, wherein the filaments of said first retention means are disposed at an oblique angle relative to the filaments of said second retention means.

3. A mounting device in accordance with claim 1, wherein said first retention means includes a plurality of said filament bundles disposed so as to define a plurality of generally concentric rings of filament bundles, and said filaments of said second retention means including a plurality of radially spaced bundles extending outwardly from said collar member.

4. A mounting device in accordance with claim 3, wherein geometric center of the filament bundles of said second retention means extend so as to lie generally in the plane defined by the terminal ends of said first mentioned filament bundles.

5. A mounting device in accordance with claim 1, wherein said first retention means includes a plurality of generally concentrically disposed rows of filament bundles, and each of said rows being disposed at a progressively greater angle than the next adjacent row in a direction toward the outer periphery of said body member.

6. A mounting device in accordance with claim 1, wherein the filament bundles of said first retention means are of a stepped-construction with the shorter filaments being disposed on the side facing said collar member.

7. A mounting device in accordance with claim 1, wherein the filaments of said first retention means are disposed at a progressively increased angle in a directional way from said collar member with the increased angular orientation being from 2° to 5° in relation to the preceding circle of filaments disposed generally concentrically in relation to the bore in said body member.

* * * * *

UNITED STATES PATENT AND TRADEMARK OFFICE

CERTIFICATE OF CORRECTION

PATENT NO. : 4,114,225

DATED : September 19, 1978

INVENTOR(S) : MALISH, et al

It is certified that error appears in the above-identified patent and that said Letters Patent are hereby corrected as shown below:

Column 4, Line 23-24-25 After "diameter" delete "the second circle may have 36 bundles with a 3/16 inch diameter, the third circle may have 40 bundles with a 3/16 inch diameter".

Column 4, Line 41, change "174" to --1/4--.

Column 5, Line 24, change "3/4" to --3/8--.

Column 5, Line 43, change "annular" to --angular--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*